US009639040B2

(12) United States Patent
Morita

(10) Patent No.: US 9,639,040 B2
(45) Date of Patent: May 2, 2017

(54) FIXING DEVICE HAVING A SUPPORT UNIT SUPPORTING A ROTATION UNIT FIXING A TONER IMAGE ONTO A SHEET SO AS TO ROTATE BY FIRST AND SECOND PROTRUSIONS

(71) Applicant: CANON FINETECH INC., Misato-shi, Saitama-ken (JP)

(72) Inventor: Hiroshi Morita, Akishima (JP)

(73) Assignee: Canon Finetech Inc., Misato-shi (JP)

( * ) Notice: Subject to any disclaimer, the term of this patent is extended or adjusted under 35 U.S.C. 154(b) by 0 days.

(21) Appl. No.: 14/141,691

(22) Filed: Dec. 27, 2013

(65) Prior Publication Data

US 2014/0186079 A1 Jul. 3, 2014

(30) Foreign Application Priority Data

Dec. 27, 2012 (JP) ..... 2012-284326
Nov. 14, 2013 (JP) ..... 2013-235527

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2035; G03G 2215/2035; G03G 2215/2038
USPC ..... 399/329
See application file for complete search history.

(56) References Cited

U.S. PATENT DOCUMENTS 5,742,878 A 4/1998 Kuroda
7,177,579 B2 * 2/2007 Uchida et al.

FOREIGN PATENT DOCUMENTS

| | | | |
|---|---|---|---|
| JP | 06-003982 | | 1/1994 |
| JP | 10247026 | A * | 9/1998 |
| JP | 11-002977 | A | 6/1999 |
| JP | 2005010201 | A * | 1/2005 |
| JP | 2007-003968 | | 1/2007 |
| JP | 2008-275754 | A | 11/2008 |
| JP | 2008275754 | A * | 11/2008 |
| JP | 2008-292750 | A | 12/2008 |
| JP | 2008292750 | A * | 12/2008 |

OTHER PUBLICATIONS

Japanese Office Action dated Apr. 28, 2015, in counterpart Japanese Patent Application No. 2013-235527.

(Continued)

*Primary Examiner* — Benjamin Schmitt
*Assistant Examiner* — Milton Gonzalez
(74) *Attorney, Agent, or Firm* — Fitzpatrick, Cella, Harper & Scinto

(57) ABSTRACT

A heating device suppresses a bias force toward a center in a longitudinal direction (center in a rotation axis direction) of a fixing film serving as a rotation member, thereby preventing film overlapping and sheet wrinkles. The sliding friction resistance in the rotation axis direction of a fixing film between the fixing film and a protrusion is set so that at least the sliding friction resistance in an end part in the rotation axis direction is larger than the sliding friction resistance in a region closer to a central part in the rotation axis direction than the end part.

12 Claims, 10 Drawing Sheets

(56) References Cited

OTHER PUBLICATIONS

Chinese Office Action issued in counterpart Chinese Patent Application No. 201310741270.3, dated Aug. 28, 2015.
Chinese Office Action issued in corresponding Chinese Application No. 201310741270.3 dated May 13, 2016.

* cited by examiner

FIXING DEVICE HAVING A SUPPORT UNIT SUPPORTING A ROTATION UNIT FIXING A TONER IMAGE ONTO A SHEET SO AS TO ROTATE BY FIRST AND SECOND PROTRUSIONS

BACKGROUND OF THE INVENTION

Field of the Invention

The present invention relates to a heating device for heating an object, a fixing device including the heating device and fixing a toner image onto a sheet, and an image forming apparatus including the heating device, such as a copier, a printer, or a fax machine.

Description of the Related Art

In a fixing device serving as a heating device for nipping, conveying, heating, and pressurizing a sheet having an unfixed toner image formed thereon, thereby fixing the toner image onto the sheet, the heat capacity of a heating member is minimized so as to enhance energy efficiency. Moreover, there has been proposed a fixing device capable of reducing the energy (power) required for increasing the temperature of a heating member to a fixing operable temperature.

The fixing device includes, for example, a heating body such as a heater which is fixed and supported, a heat-resistant fixing film serving as a band-shaped rotation unit which rotates while being press-contacted with the heating body, and a pressure member such as a roller for bringing a sheet as a material to be heated into close contact with the heating body through the intermediation of the fixing film. There has been proposed a fixing film heating system of heating and fixing an unfixed toner image formed on the surface of a sheet onto the surface of the sheet by imparting heat from the heating body to the sheet via the fixing film.

The fixing device of the fixing film heating system can use a heating body that rapidly increases in temperature, and a thin film having a low heat capacity. Therefore, the fixing device has advantages in that power can be saved and the printing standby time period can be shortened (quick start can be realized), with the result that an increase in temperature in an image forming apparatus can be suppressed.

However, although power can be saved and the printing standby time period can be shortened (quick start can be realized) by adopting a thin film as the fixing film, wrinkles are formed on a sheet when the sheet is fixed and conveyed in some cases.

When the fixing is performed to small-sized sheets consecutively, a temperature difference is caused between a part through which the small-sized sheets pass and a part through which the small-sized sheets do not pass in a rotation axis direction of the pressure roller which is being driven. The temperature difference causes a rotation speed difference in the rotation axis direction of the fixing film which is rotated in association therewith, with the result that the fixing film is warped. The warp causes a change in the entry timing of a sheet leading edge in a longitudinal direction (rotation axis direction) of the fixing film with respect to a fixing nip part (abutment part between the fixing film and the pressure roller), resulting in wrinkles on the sheet.

Regarding countermeasures against the occurrence of wrinkles on a sheet, Japanese Patent Application Laid-Open No. H11-2977 discloses a technology of preventing warp of the fixing film by setting a gap between the fixing film and a support member in the fixing film (difference between an inner circumferential length of the fixing film and an outer circumferential length of the support unit) to be small.

However, the countermeasures against the occurrence of wrinkles disclosed by Japanese Patent Application Laid-Open No. H11-2977 are insufficient, and in some cases, wrinkles may be formed on a sheet or a phenomenon may occur in which the fixing film is biased to the center thereof and is overlapped at the center (hereinafter referred to as "film overlapping").

In Japanese Patent Application Laid-Open No. H11-2977, although a gap between the fixing film and the support unit supporting the fixing film (difference between the inner circumferential length of the fixing film and the outer circumferential length of the support member) is set to be small, a special setting is not performed with respect to a gap between the fixing film and the support unit on an inner side of the fixing film in the longitudinal direction (rotation axis direction) of the fixing film.

In Japanese Patent Application Laid-Open No. H11-2977, as in Comparative Example 1 illustrated in FIG. 9, a protrusion 118*g* is provided only at a position opposed to a central part in a longitudinal direction (right and left direction of FIG. 9) of a fixing film 118*b* on an upper surface 118*r* of a heater stay 118*f* for supporting a heater 118*a* serving as a heating body.

In the configuration of FIG. 9, a gap between the fixing film 118*b* and the support unit is small in the central part (protrusion 118*g*), compared to that in end parts. This configuration causes film overlapping that is a phenomenon in which the fixing film 118*b* itself is biased to the center in the longitudinal direction when a sheet, to which the fixing is performed, passes or causes wrinkles which are a sign of film overlapping to occur on a sheet. Further, the configuration strengthens the force that causes the fixing film 18*b* to be biased to the center thereof in the longitudinal direction, resulting in that film overlapping and wrinkles on a sheet cannot be sufficiently prevented.

SUMMARY OF THE INVENTION

In order to solve the above-mentioned problems, the present invention provides a heating device capable of preventing film overlapping and wrinkles on a sheet by suppressing a force that causes a fixing film serving as a rotation unit to be biased to the center in a longitudinal direction (rotation axis direction).

In order to achieve the above-mentioned object, according to one embodiment of the present invention, there is provided a heating device, including: a support unit; and a rotation unit having a band shape, rotating around the support unit, and heating an object. The sliding friction resistance in a rotation axis direction of the rotation unit between the rotation unit and the support unit is set so that at least the sliding friction resistance in a first region in the rotation axis direction is larger than the sliding friction resistance in a second region closer to a central part in the rotation axis direction than the first region.

Further features of the present invention will become apparent from the following description of exemplary embodiments with reference to the attached drawings.

DESCRIPTION OF THE EMBODIMENTS

An image forming apparatus including a fixing device according to an embodiment of the present invention is described specifically with reference to the drawings.

First Embodiment

Figure 1:
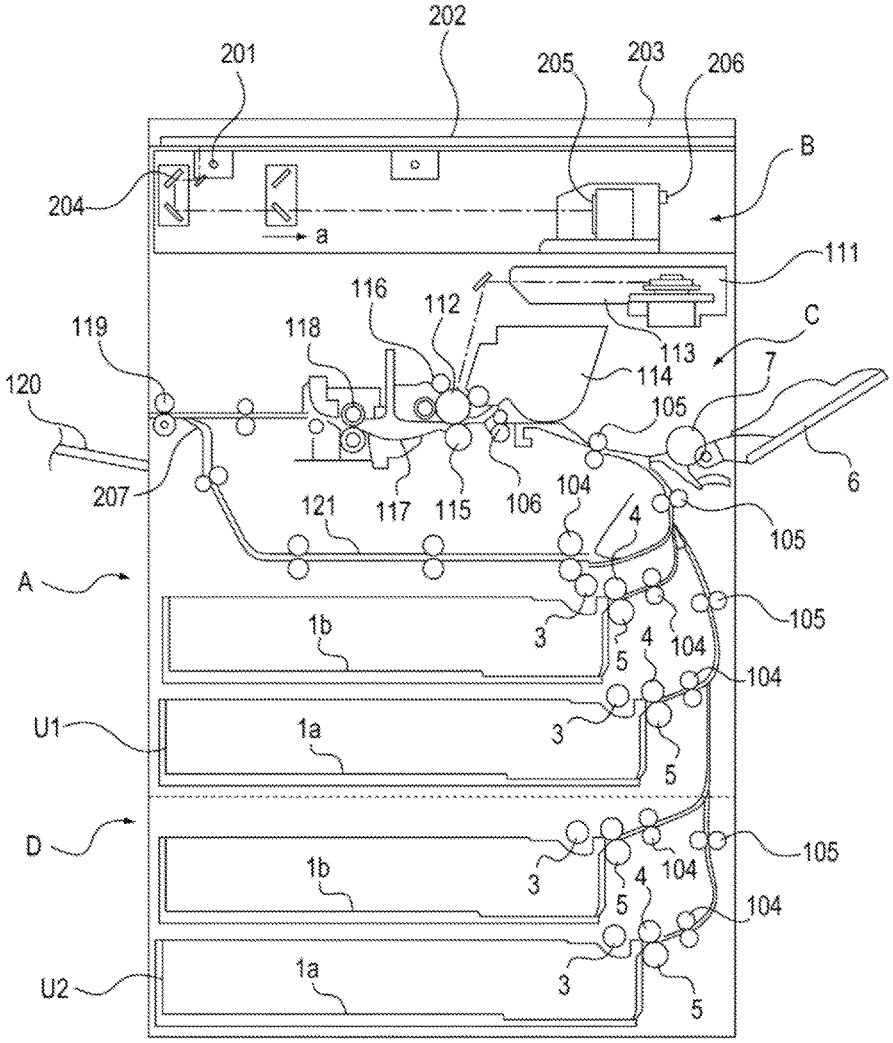
FIG. 1 is a sectional explanatory diagram illustrating a configuration of an image forming apparatus including a fixing device according to a first embodiment of the present invention.

First, a configuration of an image forming apparatus including a fixing device serving as a heating device according to a first embodiment of the present invention is described with reference to FIGS. 1 to 5, 10, and 11. FIG. 1 illustrates an example in which the present invention is applied to a copier serving as an image forming apparatus.

Image Forming Apparatus

FIG. 1 illustrates an entire configuration of the copier serving as the image forming apparatus according to the first embodiment. A scanner part B serving as an image reading unit for reading image information from a book original is disposed above an image forming apparatus main body A. An image forming part C serving as an image forming unit is provided below the scanner part B, and a sheet deck D is provided below the image forming part C.

The scanner part B includes a scanning system light source 201, a platen glass 202, an original pressure plate 203 capable of being opened/closed with respect to the image forming apparatus main body A, a mirror 204, a lens 205, a light-receiving element 206 made of a photoelectric converting element, an image processing part, and the like.

A book original, such as a book or a sheet-shaped original, is placed on the platen glass 202 with an original surface faced downward, and the back surface of the original is pressed by the original pressure plate 203 so that the original is set in a stationary state. When a read start key is pressed, the scanning system light source 201 scans the lower part of the platen glass 202 in a direction of an arrow "a" of FIG. 1 and reads image information from the original surface.

The original image information read by the scanning system light source 201 is processed in the image processing part and converted into an electric signal. The electric signal is transmitted to a laser scanner 111 of the image forming part C. The image forming apparatus main body A functions as a copier when a processing signal of the image processing part is input to the laser scanner 111 of the image forming part C, and functions as a printer when an output signal of an external device such as a computer is input. Further, the image forming apparatus main body A functions as a fax machine when a signal is received from another fax machine or a signal of the image forming part is transmitted to another fax machine.

A sheet cassette is mounted on the image forming apparatus main body A and the sheet deck D. Two sets of a lower-stage cassette 1*a* and an upper-stage cassette 1*b* are provided in each of feed units U1 and U2, and a total of four sheet cassettes are mounted on the image forming apparatus main body A and the sheet deck D.

The feed unit U1 disposed on an upper side of the sheet deck D is removably mounted on the image forming apparatus main body A, and the feed unit U2 disposed on a lower side of the sheet deck D is removably mounted on the sheet deck D.

Sheets received in the lower-stage cassette 1*a* and the upper-stage cassette 1*b* are picked up by a pickup roller 3 serving as a feed rotation member. Then, the sheets are separated and fed one by one owing to the coordinating function of a feed roller 4 and a retard roller 5, and thereafter, conveyed to registration rollers 106 by conveyance rollers 104, 105. The sheets are fed to the image forming part C in synchronization with the image forming operation by the registration rollers 106. Further, a manual feed tray 6 is disposed on a side surface side of the image forming apparatus main body A, separately from the sheet cassette, and sheets on the manual feed tray 6 are fed by a manual feed roller 7 to the registration rollers 106.

The image forming part C includes a photosensitive drum 112 serving as an image bearing member, the laser scanner 111, a charging roller 116, a developing device 114, a transfer roller 115, a fixing device 118, and the like. The laser scanner 111 scans the surface of the photosensitive drum 112, which is uniformly charged by the charging roller 116, with laser light corresponding to image information and output from the laser scanner 111, with the result that an electrostatic latent image is formed on the surface of the photosensitive drum 112. A toner is supplied to the electrostatic latent image and developed by the developing device 114. As a result, a toner image is formed.

The toner image formed on the surface of the photosensitive drum 112 is transferred onto a first surface of a sheet sent from the registration rollers 106 in synchronization with the rotation of the photosensitive drum 112 in a transfer part in which the transfer roller 115 is disposed.

The sheet having the toner image formed thereon in the transfer part is conveyed by a conveyance part 117 and sent to the fixing device 118. The sheet is heated and pressurized in the fixing device 118, with the result that the toner image is fixed onto the sheet, and thereafter, the sheet is delivered by delivery rollers 119 onto a delivery tray 120 disposed outside of the apparatus.

In the case where an image is recorded on both surfaces of a sheet, the sheet discharged from the fixing device 118 is nipped by the delivery rollers 119. At a time point when a trailing edge of the sheet passes through a branch point 207, the delivery rollers 119 are rotationally driven in a reverse direction. Thus, the sheet is conveyed to a double-side conveyance path 121. After that, the sheet is conveyed again by the conveyance rollers 104, 105 and reaches the registration rollers 106 with the sheet being inverted. A toner image is formed on a second surface of the inverted sheet in the same way as in the above, and thereafter, is delivered onto the delivery tray 120.

Fixing Device

Figure 2:
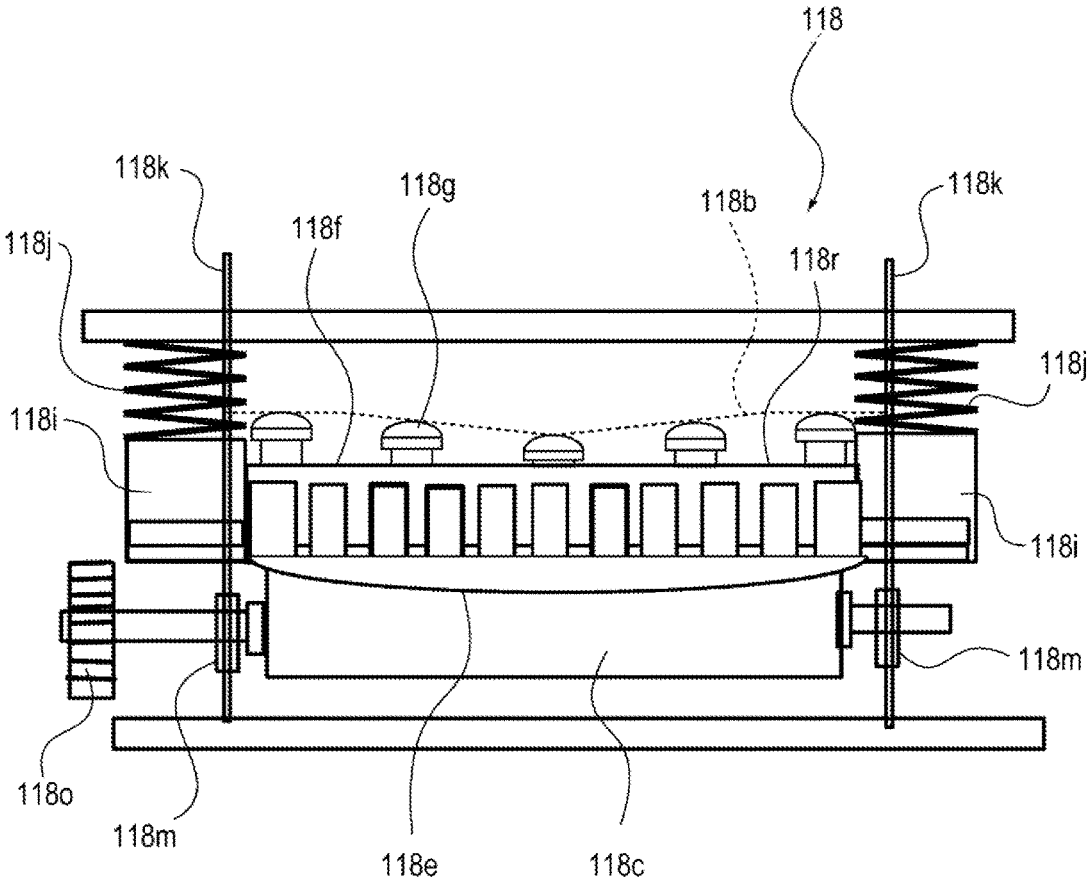
FIG. 2 is a schematic sectional view illustrating a configuration of the fixing device according to the first embodiment.
Figure 3:
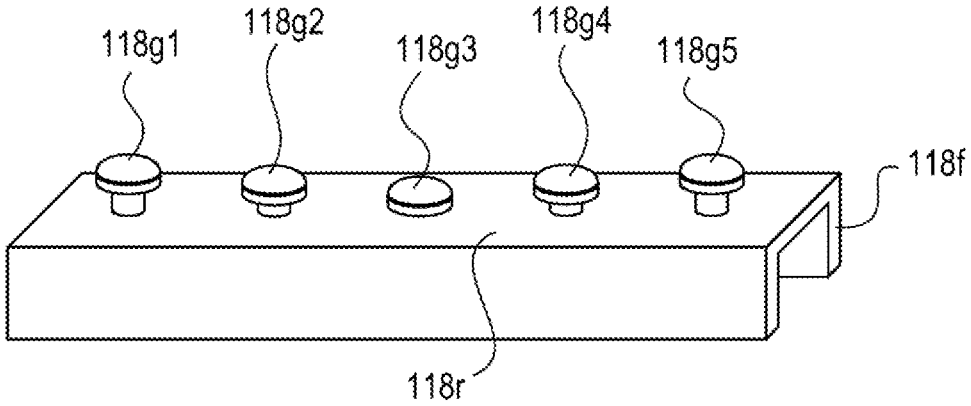
FIG. 3 is a perspective explanatory diagram illustrating a configuration of protrusions protruding on an outer circumferential surface of a guide member of the fixing device according to the first embodiment.
Figure 4B:
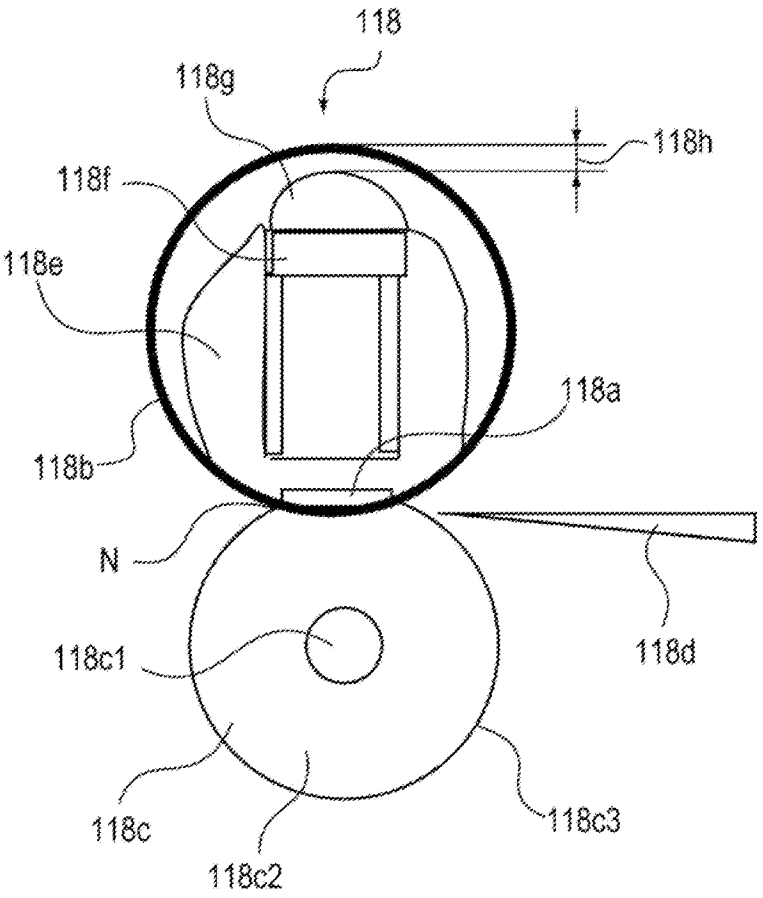
FIG. 4B is a schematic sectional view of the central part of the fixing film, illustrating a state of the fixing film during suspension of the pressure member of the fixing device according to the first embodiment.
Figure 4A:
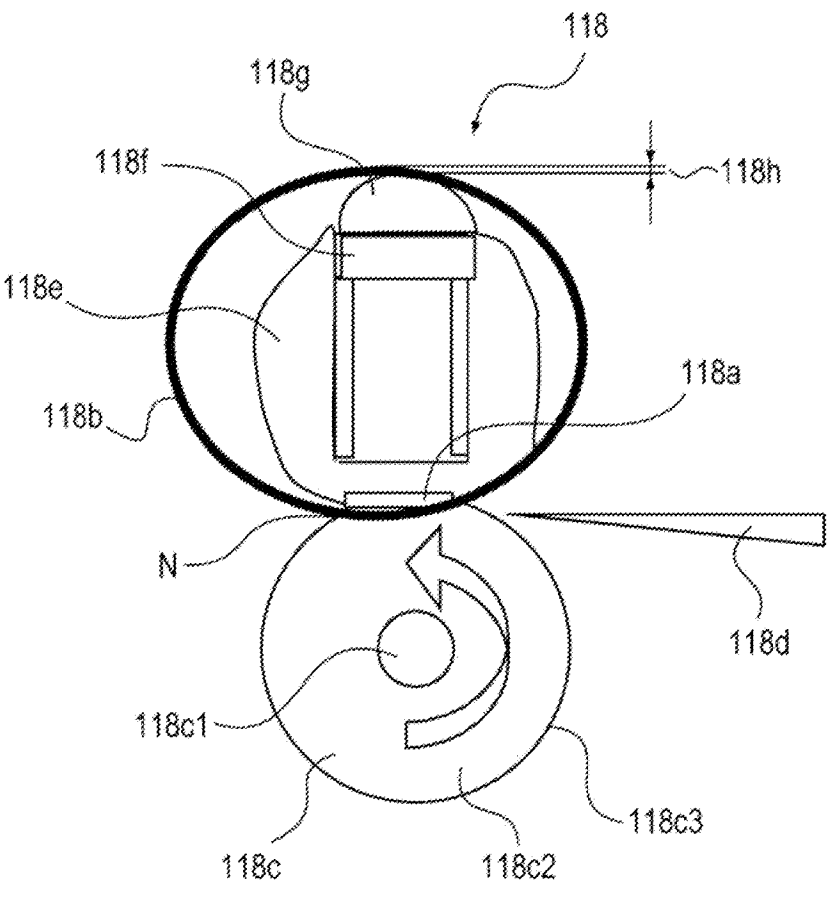
FIG. 4A is a schematic sectional view of a central part of a fixing film, illustrating a state of the fixing film during rotation of a pressure member of the fixing device according to the first embodiment.

Next, a configuration of the fixing device 118 serving as a heating device is described with reference to FIGS. 2, 3, 4A, and 4B. FIG. 2 is a schematic front sectional view illustrating the configuration of the fixing device 118, and part of a fixing film 118*b* serving as a band-shaped rotation unit is represented by a broken line. FIG. 3 is a perspective explanatory diagram illustrating a configuration of protrusions 118*g* protruding from an upper surface 118*r* which is an outer circumferential surface of a heater stay 118*f* serving as a guide member for guiding the fixing film 118*b*. FIG. 4A is a schematic side sectional view illustrating a state of the fixing film 118*b* which is rotated in association with the rotation of a pressure roller 118*c* serving as a pressure member of the fixing device 118. FIG. 4B is a schematic side sectional view illustrating a state of the fixing film 118*b* during suspension of the pressure roller 118*c* serving as the pressure member of the fixing device 118.

The fixing device 118 illustrated in FIGS. 2, 4A, and 4B includes a heater 118*a* serving as a heat generator, and a film guide 118*e* serving as a guide member for supporting the heater 118*a* and guiding the fixing film 118*b*. The heater stay 118*f* holds the film guide 118*e*.

Further, the fixing device 118 includes the fixing film 118*b* in a tubular shape serving as a heating rotation member which slides and rotates around an outer circumference of the heater stay 118*f* and the film guide 118*e*, and the pressure roller 118*c* serving as a pressure member that rotates while coming into pressure-abutment against the outer circumferential surface of the fixing film 118*b* and rotates. The heater 118*a* is disposed on an inner side of the fixing film 118*b*.

The film guide 118*e* and the heater stay 118*f* for guiding the fixing film 118*b* serving as a rotation unit form a support unit. The fixing film 118*b* is formed as a band-shaped rotation unit which rotates around the support unit and heats a toner image formed on a sheet which is an object.

There is provided an inlet guide 118*d*. A region of the heater stay 118*f* serving as a guide member, which does not come into abutment against the pressure roller 118*c* serving as a pressure member through intermediation of the fixing film 118*b*, is considered. In that region, multiple protrusions 118*g* capable of coming into abutment against the inner circumferential surface of the fixing film 118*b* are fixed on the upper surface 118*r* which is an outer circumferential surface of the heater stay 118*f* along a longitudinal direction (right and left direction of FIG. 2) of the heater stay 118*f*. The upper surface 118*r* is a surface on an opposite side to a surface on which a fixing nip part N with respect to the pressure roller 118*c* is formed.

In the first embodiment, the upper surface 118*r* of the heater stay 118*f* is formed as a flat surface. The height of a protrusion 118*g*3, which is at a central part in the longitudinal direction (right and left direction of FIG. 2) of the heater stay 118*f*, from the upper surface 118*r* of the heater stay 118*f* is as follows. The height of the protrusion 118*g*3 in the central part from the upper surface 118*r* of the heater stay 118*f* is set so as to be smaller than that of protrusions 118*g*1, 118*g*5, which are on an end part side in the longitudinal direction (right and left direction of FIG. 2) of the heater stay 118*f*, from the upper surface 118*r* of the heater stay 118*f*.

A region of the heater stay 118*f* serving as a guide member, which does not come into abutment against the pressure roller 118*c* serving as a pressure member through intermediation of the fixing film 118*b*, is considered. A distance between the protrusion 118*g*3 in the central part in the longitudinal direction (right and left direction of FIG. 2) of the heater stay 118*f* and the inner circumferential surface of the fixing film 118*b* is considered. Further, a distance between the protrusions 118*g*1, 118*g*5 on the end part side which corresponds to a first region in the longitudinal direction (right and left direction of FIG. 2) of the heater stay 118*f* and the inner circumferential surface of the fixing film 118*b* is considered.

The distance between the protrusion 118*g*3 in the central part which is a second region positioned closer to the central part in the rotation axis direction than the first region and the inner circumferential surface of the fixing film 118*b* is set to be larger than that between the protrusions 118*g*1, 118*g*5 on the end part side and the inner circumferential surface of the fixing film 118*b*.

In FIGS. 2, 4A, and 4B, both ends of the heater stay 118*f* in the longitudinal direction (right and left direction of FIG. 2) and flange caps 118*i* are fitted with each other. A groove part (not shown) provided on a side surface of each flange cap 118*i* on each end part is fitted to an edge part of a slide groove part provided in a vertical direction on a side plate 118*k* serving as a frame body so as to be movable in the vertical direction of FIG. 2 along the slide groove part.

The upper surface of the flange cap 118*i* in each end part is urged by a pressure spring 118*j*. Consequently, the flange cap 118*i*, the heater stay 118*f*, the film guide 118*e*, and the heater 118*a* are brought into abutment against the pressure roller 118*c* through intermediation of the fixing film 118*b* in the stated order under a predetermined pressure force.

As illustrated in FIGS. 4A and 4B, the fixing film 118*b* and the pressure roller 118*c* form the fixing nip part N. A cored bar 118*c*1 serving as a rotation shaft of the pressure roller 118*c* is axially supported rotatably by a pressure roller bearing 118*m* fixed to the side plate 118*k* illustrated in FIG. 2 and is rotationally driven by a motor (not shown) via a drive gear 118*o*.

As illustrated in FIG. 4A, when the pressure roller 118*c* rotates, the fixing film 118*b* which is held in press-contact with the surface of the pressure roller 118*c* rotates in association therewith so as to slide around the outer circumferential surface of the film guide 118*e*. A sheet having the surface on which an unfixed toner image has been formed is nipped between the fixing film 118*b* and the pressure roller 118*c* and conveyed while being heated and pressurized.

In a transfer nip part formed by the photosensitive drum 112 and the transfer roller 115 illustrated in FIG. 1, the sheet having the surface onto which an unfixed toner image has been transferred is conveyed to the fixing nip part N along the inlet guide 118*d* illustrated in FIGS. 4A and 4B. The sheet is supplied with predetermined heat and pressure, with the result that the toner image is fixed onto the surface of the sheet, and thereafter the sheet is delivered out of the image forming apparatus main body A.

Heat Generator

In the first embodiment, the heater 118*a* serving as a heat generator is a heater obtained as follows. On an alumina ($Al_2O_3$) substrate having a thickness of 1 mm, a heat-generating resistor of silver (Ag) is screen-printed to have a predetermined width and thickness. Then, protective glass is coated on its surface. The heat generator thus obtained is fixed to the film guide 118*e*.

The heater 118*a* is fixed to and supported by the film guide 118*e* with the surface side thereof exposed downwardly. A thermister (not shown) is provided in contact with the back surface side of the heater 118*a*.

Guide Member

In the first embodiment, the film guide 118*e*, the heater stay 118*f*, and the protrusions 118*g* function as a guide member serving as a support unit. The film guide 118*e* serving as a guide member for guiding the fixing film 118*b* can be made of a phenol resin, a polyimide resin, a polyamide resin, a polyamide-imide resin, a polyetheretherketone (PEEK) resin, or a polyether sulfone (PES) resin.

Further, the film guide 118*e* is made of a material having satisfactory insulation and heat resistance such as a polyphenylene sulfide (PPS) resin, a fluorine resin, a liquid crystal polymer (LCP) resin, and a mixed resin thereof. As the material for the protrusions 118*g*, the same material as that of the guide member can be applied, and a material having satisfactory insulation and heat resistance is used.

As the material for the heater stay 118*f* serving as a guide member for guiding the fixing film 118*b*, a metal which is inexpensive and has high workability and excellent strength such as iron, stainless steel (SUS), and aluminum is used. The heater stay 118*f* is formed into a substantially U-shape in a cross-section as illustrated in FIG. 2 so as to be excellent in strength and to have small heat capacity, and further to contain a temperature detecting element and a safety element.

It is preferred that the heater stay 118*f* have a plate thickness capable of satisfying both the prevention of warp with respect to a pressure force and the reduction in heat capacity. Further, the heater stay 118*f* is formed so as to contain a temperature detecting member or the like as necessary. The outer circumferential surface of the protrusions 118*g* protruding on the upper surface 118*r* of the heater stay 118*f* and the inner circumferential surface of the fixing film 118*b* relatively slide on each other while being held in contact with each other.

Fixing Film

As the fixing film 118*b* serving as a rotation unit, a composite layer film can be used, which includes a base layer made of a resin material containing a heat-resistant component as a base or a metal material such as stainless steel (SUS), a heat-resistant elastic layer serving as an intermediate layer, and a releasing layer formed by covering the outer circumferential surface of the heat-resistant elastic layer with a fluorine resin. The fixing film 118*b* of the first embodiment is formed so as to have an outer diameter of 24 mm. Then, the fixing film 118*b* is brought into press-contact with the outer circumferential surface of the rotating pressure roller 118*c* so as to rotate in association with the rotating pressure roller 118*c*.

Pressure Member

The pressure roller 118*c* serving as a pressure member includes the cored bar 118*c*1 serving as a rotation shaft, a heat-resistant rubber elastic layer 118*c*2 provided on the outer circumferential surface of the cored bar 118*c*1, and a fluorine resin layer 118*c*3 provided on the outer circumferential surface of the heat-resistant rubber elastic layer 118*c*2. As a rubber material to be used for the heat-resistant rubber elastic layer 118*c*2, a heat-resistant ethylene propylene rubber, a silicone rubber, a fluorine rubber, or a rubber having a foam body (sponge) structure of the aforementioned rubbers can be applied.

Figure 6:
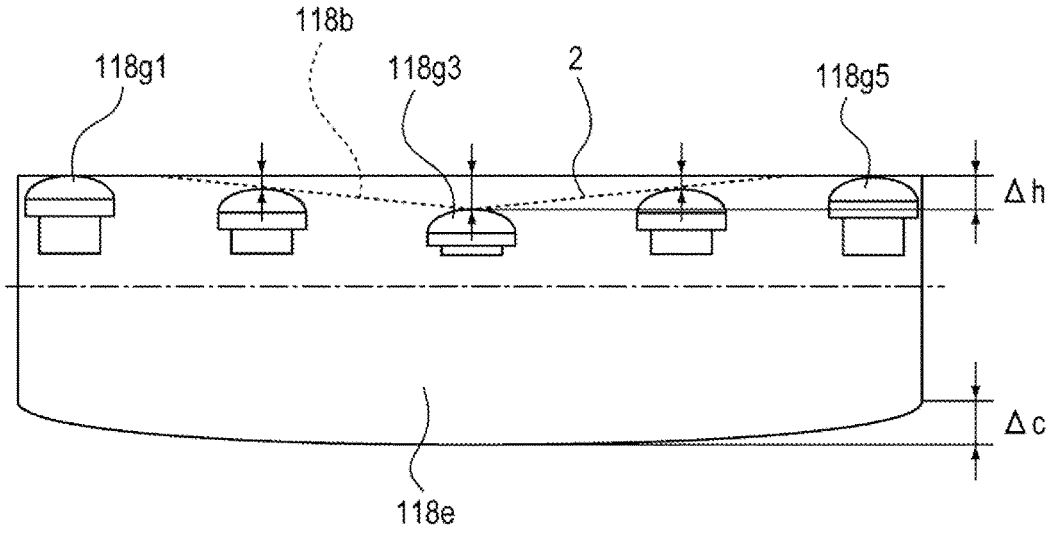
FIG. 6 is a schematic view illustrating a relationship between a crown amount of a fixing nip part of a film guide serving as a guide member in the fixing device according to the first embodiment, and a gap between an inner circumferential surface of the fixing film and a guide surface (protrusion) of the guide member.

In the first embodiment, as illustrated in FIGS. 2 and 6, a region of the film guide 118*e* to be a guide member for guiding the fixing film 118*b* is formed into a crown shape, in which the outer diameter in the central part is larger than those in the end parts, along the longitudinal direction of the film guide 118*e*.

A dimension difference between the outer diameter in the end parts in the longitudinal direction of the crown-shaped film guide 118*e* and the outer diameter in the central part is set to Δc (0.3 mm in the first embodiment).

The protrusion 118*g*3, which is in the central part in the longitudinal direction of the heater stay 118*f* and is to be a guide member illustrated in FIG. 6, has the height of 1.00 mm from the upper surface 118*r* of the heater stay 118*f* in the first embodiment. The protrusions 118*g*1, 118*g*5, which are on the end parts side, have the height of 1.35 mm from the upper surface 118*r* of the heater stay 118*f* in the first embodiment. The dimension difference between the protrusion 118*g*3 and the protrusions 118*g*1, 118*g*5 in height is set to Δh (0.35 mm in the first embodiment).

Figure 7:
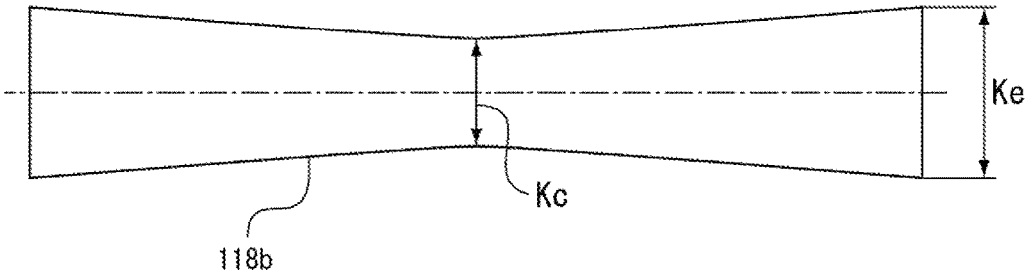
FIG. 7 illustrates a reversed crown amount in a longitudinal direction of the fixing film.

As illustrated in FIG. 7, the fixing film 118*b* alone has a reversed crown shape in which an inner diameter Kc in the central part in the axial direction (right and left direction of FIG. 7) (central part in the rotation axis direction) of the fixing film 118*b* in a tubular shape is smaller than an inner diameter Ke thereof in the end parts. An inner diameter difference Δi between the inner diameter Ke in the end parts in the longitudinal direction (end parts in the rotation axis direction) of the fixing film 118*b* having a reversed crown shape and the inner diameter Kc thereof in the central part is set to 50 μm.

The inner diameter difference Δi, the inner diameter Ke, and the inner diameter Kc are represented by the following numerical expression 1.

$$\Delta i = Ke - Kc \quad \text{(Expression 1)}$$

A relationship of the dimension difference Δh, the inner diameter difference Δi, and the dimension difference Δc illustrated in FIGS. 6 and 7 is as represented by the following numerical expression 2.

$$\Delta h > \Delta i + \Delta c \quad \text{(Expression 2)}$$

Thus, during the suspension of the pressure roller 118*c* and the fixing film 118*b* illustrated in FIG. 4B, a gap 118*h* between the inner circumferential surface of the fixing film 118*b* and the guide surface of the guide member is set as follows. The guide surface of the guide member is formed of the film guide 118*e*, the heater stay 118*f*, and the protrusions 118*g*. The gap 118*h* (1.25 mm in the first embodiment) in the end part in the longitudinal direction of the fixing film 118*b* is set to be smaller than the gap 118*h* (1.5 mm in the first embodiment) in the central part.

FIG. 4A illustrates a state in which the fixing film 118*b* is rotationally driven by the pressure roller 118*c*, is brought into abutment against the pressure roller 118*c* and rotates in association therewith. The gap 118*h* is smaller than that illustrated in FIG. 4B in which the fixing film 118*b* is suspended. The rotating fixing film 118*b* and the protrusion 118*g* are held in contact with each other, and the gap 118*h* therebetween is 0.

Consequently, the rotating fixing film 118*b* can be prevented from warping in the longitudinal direction. Further, the gap 118*h* between the outer circumferential surface of the protrusions 118*g*1, 118*g*5 in the end parts in the longitudinal direction and the fixing film 118*b* is smaller than the gap 118*h* between the outer circumferential surface of the protrusion 118*g*3 in the central part in the longitudinal direction and the fixing film 118*b*, and the protrusions 118*g*1, 118*g*5 are higher than the protrusion 118*g*3. This increases the contact pressure on the end part side of the rotating fixing film 118*b* to increase the sliding resistance. That is, the sliding friction resistance in the end part which is the first region becomes larger than the sliding friction resistance on the central part side which is the second region. Thus, the retention force in the end parts of the fixing film 118*b* becomes large to suppress a bias force toward the central part in the longitudinal direction, which can prevent film overlapping.

Figure 8:
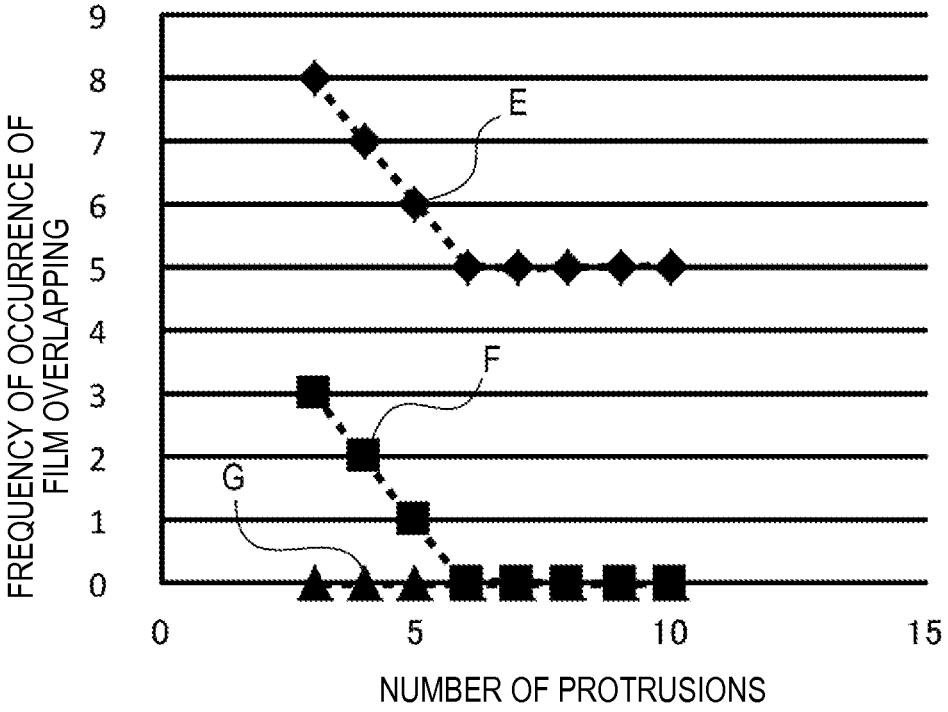
FIG. 8 is a graph illustrating relationships between the number of protrusions protruding on the outer circumferential surface of the guide member of the fixing device according to the first embodiment and the frequency of occurrence of film overlapping of the fixing film, compared to each other based on a thickness of the fixing film and presence/absence of reversed crown of the guide member.

FIG. 8 illustrates the frequency of occurrence of film overlapping when, as an experimental condition, the fixing device 118 illustrated in FIG. 2 is rotated at 100 rpm while the temperature is controlled at 200° C. under an N/N environment (temperature: 23° C., humidity: 50%) and plain paper of an A3 size having a paper weight of 80 g is passed through the fixing device 118.

FIG. 8 illustrates the results obtained by conducting an experiment of the frequency of occurrence of film overlapping 10 times through use of the fixing film 118*b* having a thickness of 40 μm which is smaller than that of the ordinary fixing film and the fixing film 118*b* having a thickness of 70 μm which is the ordinary thickness, in order to clarify a relationship between the shape of the protrusion 118*g* and the film overlapping. The horizontal axis of FIG. 8 represents the number of the protrusions 118*g* protruding on the upper surface 118*r* of the heater stay 118*f* serving as a guide member, and the vertical axis represents the frequency of occurrence of film overlapping.

In Comparative Example E illustrated in FIG. 8, the thickness of the fixing film 118*b* is set to 40 μm, and the height of the multiple protrusions 118*g* from the upper surface 118*r* of the heater stay 118*f* is set to be identical (1.35 mm in Comparative Example E).

In Example F, the thickness of the fixing film 118*b* is set to 40 μm, and the height of the multiple protrusions 118*g* from the upper surface 118*r* of the heater stay 118*f* is smaller in the central part in the longitudinal direction of the heater stay 118*f* and increases gradually toward the end parts so that the protrusions 118*g* have a reversed crown shape.

For example, the height of the protrusions 118*g* from the upper surface 118*r* of the heater stay 118*f* in the case where the total number of the protrusions 118*g* is five is as follows. The height of the protrusion 118*g* is 1.35 mm in both the end parts in the longitudinal direction of the heater stay 118*f*, 1.0 mm in the central part, and 1.175 mm in regions between the central part and both the end parts.

In Example G, the thickness of the fixing film 118*b* is set to 70 μm, and the height of the multiple protrusions 118*g* from the upper surface 118*r* of the heater stay 118*f* is smaller in the central part in the longitudinal direction of the heater stay 118*f* and increases gradually toward the end parts so that the protrusions 118*g* have a reversed crown shape.

The frequency of occurrence of film overlapping is smaller in the case where the multiple protrusions 118*g* have a reversed crown shape as in Examples F and G of FIG. 8, compared to the case where the multiple protrusions 118*g* do not have a reversed crown shape or have a flat shape as in Comparative Example E. It is understood that there is an effect that the frequency of occurrence of film overlapping is reduced by increasing the number of the protrusions 118*g*, for example, by providing 4 or more protrusions 118*g* along the longitudinal direction of the heater stay 118*f*.

It is understood from Example G that film overlapping does not occur in the fixing film 118*b* under the following conditions: the thickness of the fixing film 118*b* is 70 μm which is the ordinary thickness; the protrusions 118*g* have a reversed crown shape in which the height increases gradually toward the end parts; and the number of the protrusions 118*g* is 3 or more.

Figure 11:
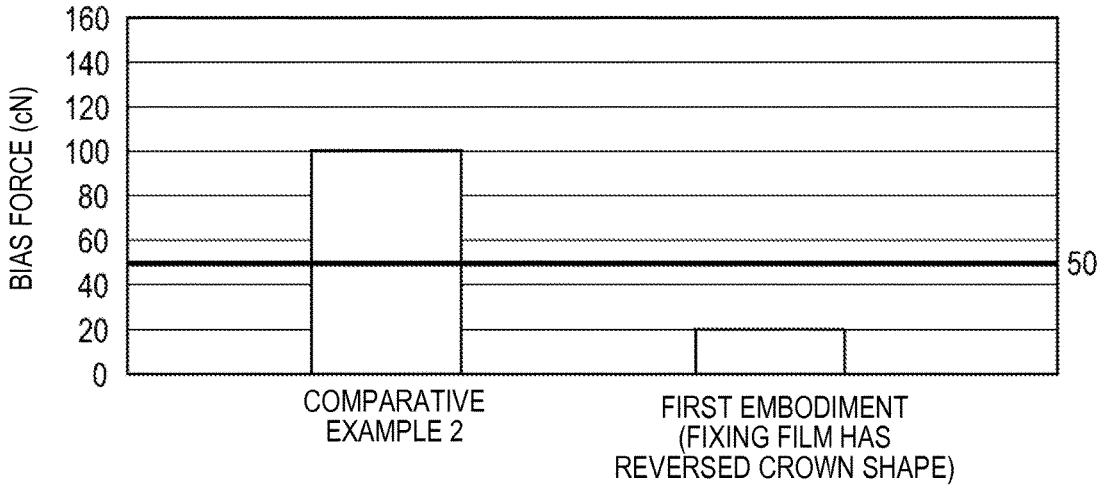
FIG. 11 illustrates a comparison of bias forces in the longitudinal direction of the fixing film between the first embodiment and Comparative Example 2.

The right side of FIG. 11 illustrates the graph obtained by measuring a bias force (film overlapping force) in the central part in the longitudinal direction of the fixing film 118*b* through use of the first embodiment illustrated in FIGS. 3 and 7.

The heights of 5 protrusions 118*g* were set so that the shape formed by extending and connecting the outer circumferential surfaces of the 5 protrusions 118*g* provided on the upper surface 118*r* of the heater stay 118*f* according to the first embodiment illustrated in FIG. 3 became a reversed crown shape. Then, the fixing film 118*b* in a tubular shape having an inner diameter of a reversed crown shape illustrated in FIG. 7 slides and rotates around the outer circumference of the protrusions 118*g*.

The left side of FIG. 11 illustrates the graph of Comparative Example 2 (not shown) in which 5 protrusions 118*g* are provided on the upper surface 118*r* of the heater stay 118*f* as illustrated in FIG. 3, and the heights of the 5 protrusions 118*g* are set to be identical. The fixing film 118*b* in a tubular shape having an inner diameter of a reversed crown shape in the axial direction slides and rotates around the outer circumference of the protrusions 118*g*.

A design target value of a bias force in the central part in the longitudinal direction of the fixing film 118*b*, at which bias (film overlapping) does not occur, is experimentally determined to be 50 cN. In the configuration of Comparative Example 2 (not shown), the bias force was 100 cN with respect to the target value as illustrated in FIG. 11. On the other hand, in the configuration of the first embodiment illustrated in FIGS. 3 and 6, the bias force was 20 cN.

In the first embodiment, the bias force was equal to or less than 50 cN that is a bias force target value at which film overlapping does not occur. The bias force is reduced by increasing the number of the protrusions 118*g* provided on the upper surface 118*r* of the heater stay 118*f*. In order to set the bias force to be equal to or less than cN that is a bias force target value at which film overlapping does not occur, the heights of the 5 protrusions 118*g* are set so that the shape formed by extending and connecting the outer circumferential surfaces of the 5 protrusions 118*g* provided on the upper surface 118*r* of the heater stay 118*f* becomes a reversed crown shape.

FIG. 4A is a schematic sectional view illustrating a state in which the fixing film 118*b* is rotationally driven by the pressure roller 118*c*, is brought into abutment against the pressure roller 118*c* and rotates in association therewith. FIG. 4B is a schematic sectional view illustrating a state in which the pressure roller 118*c* and the fixing roller 118*b* are suspended. The gap 118*h* between the outer circumferential surface of the protrusions 118*g* and the inner circumferential surface of the fixing film 118*b* illustrated in FIGS. 4A and 4B influences the occurrence of wrinkles on a sheet. Therefore, it has been proposed to set the gap 118*h* to an arbitrary numerical value.

Figure 9:
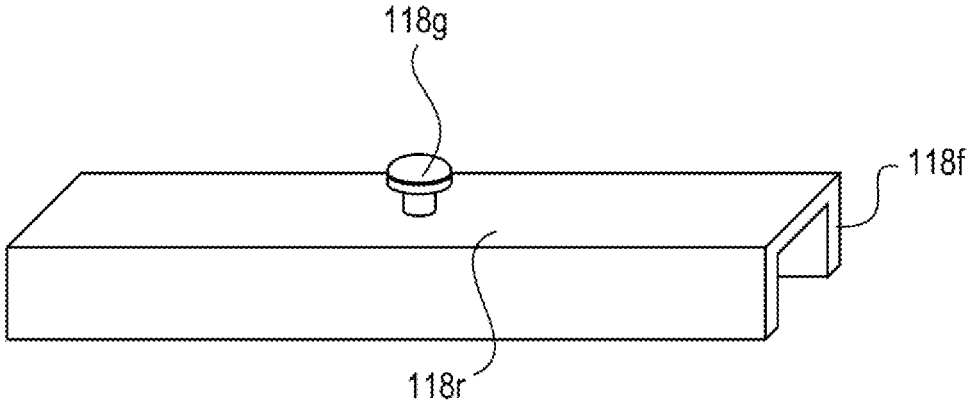
FIG. 9 PRIOR ART
FIG. 9 is a perspective explanatory diagram illustrating a configuration according to Comparative Example 1 in which a protrusion is provided on an outer circumferential surface of a guide member of a fixing device.

However, in Comparative Example 1 illustrated in FIG. 9, the magnitude of the gap 118*h* between the inner circumferential surface of the fixing film 118*b* and the outer circumferential surface of the protrusions 118*g* in the longitudinal direction of the fixing film 118*b* was not defined. Therefore, wrinkles occurred on a sheet, and film overlapping that is a phenomenon in which the fixing film 118*b* is biased to the center occurred.

FIG. 9 illustrates an example of the arrangement of the protrusions 118*g* of Comparative Example 1. In Comparative Example 1 illustrated in FIG. 9, the protrusion 118*g* having a height of 1.35 mm from the upper surface 118*r* was provided only at one position in the central part in the longitudinal direction of the upper surface 118*r* of the heater stay 118*f*.

In Comparative Example 1, when small-sized sheets pass through the fixing nip part N consecutively, the temperature of a non-sheet passing part in the longitudinal direction of the pressure roller 118*c* rises and the non-sheet passing part expands, with the result that the outer diameter of the pressure roller 118*c* in the non-sheet passing part becomes large. Therefore, the rotation speed of the fixing film 118*b* becomes higher in the non-sheet passing part than that in the sheet passing part in the longitudinal direction of the pressure roller 118*c*, and the fixing film 118*b* is distorted.

Consequently, in the sheet passing region, the fixing film 118*b* sags on an upstream side in the sheet conveyance direction (right side of FIGS. 4A and 4B) with respect to the fixing nip part N formed by the heater 118*a* and the pressure roller 118*c*. Then, a phenomenon occurs in which, a sheet is wrinkled by the resistance caused by the sagging of the fixing film 118*b*, when the leading edge of the sheet enters the fixing nip part N.

In Comparative Example 1 illustrated in FIG. 9, in order to prevent wrinkles from occurring, the protrusion 118*g* is provided in the vicinity of the central part in the longitudinal direction of the heater stay 118*f*. Consequently, a difference between the inner circumferential length of the fixing film 118*b* and the outer circumferential length of the guide member formed of the heater stay 118*f* including the protrusion 118*g* and the film guide 118*e* is reduced. When the warp amount of the fixing film 118*b* is reduced, wrinkles can be prevented from occurring on a sheet to some degree.

In Comparative Example 1 illustrated in FIG. 9, the protrusion 118*g* is added only in the vicinity of the central part in the longitudinal direction of the heater stay 118*f*. With the foregoing configuration, the gap 118*h* between the inner circumferential surface of the fixing film 118*b* in the central part in the longitudinal direction of the fixing film 118*b* and the guide surface of the guide member for supporting the fixing film 118*b* is smaller than the gap 118*h* between the inner circumferential surface of the fixing film 118*b* in the end parts in the longitudinal direction of the fixing film 118*b* and the guide surface of the guide member for supporting the fixing film 118*b*.

In the above-mentioned case, although the warping in the central part in the longitudinal direction of the fixing film 118*b* can be prevented from occurring by the protrusion 118*g*, a sheet contracts during heating due to the evaporation of moisture. Further, a sheet, to which the fixing is performed, takes heat from the thermally expanding fixing film 118*b*, with the result that the fixing film 118 contracts. In the above-mentioned case, no good effect against those phenomena is obtained and rather entails adverse effects.

The protrusion 118*g*3 is provided in the central part in the longitudinal direction of the heater stay 118*f*. Thus, the film guide 118*e* serving as a guide member for supporting the fixing film 118*b* has a region, which comes into abutment against the pressure roller 118*c* serving as a pressure member through intermediation of the fixing film 118*b*, and the region is formed into a crown shape. The crown shape refers to a shape in which the outer diameter is larger in the central part than those in the end parts along the longitudinal direction of the heater stay 118*f*. As a result, a phenomenon in which the fixing film 118*b* contracts in the central part in the longitudinal direction due to the passage of a sheet is accelerated.

In the first embodiment, as illustrated in FIG. 3, the height of the protrusion 118*g*3 in the central part in the longitudinal direction of the heater stay 118*f* from the upper surface 118*r* of the heater stay 118*f* is small. The height of the protrusion 118*g*3 in the central part from the upper surface 118*r* is 1.0 mm in FIG. 3. The heights of the protrusions 118*g*2, 118*g*4 provided on an outer side of the protrusion 118*g*3 so as to be adjacent thereto are 1.175 mm, respectively. The heights of the protrusions 118*g*1, 118*g*5 in both the end parts from the upper surface 118*r* are 1.35 mm, respectively.

The height of the protrusions 118*g* from the upper surface 118*r* of the heater stay 118*f* is set so as to increase gradually from the central part to both the end parts. Thus, the outer circumferential surface of the guide member for supporting the fixing film 118*b* has a reversed crown shape in which the outer diameter increases from the central part to the end parts in the longitudinal direction.

The arrangement of the protrusions 118*g* in the longitudinal direction of the heater stay 118*f* is formed into a reversed crown shape. With this arrangement, the gap 118*h* between the inner circumferential surface of the fixing film 118*b* in the central part in the longitudinal direction of the fixing film 118*b* and the guide surface of the guide member for supporting the fixing film 118*b* is set so as to be larger than the gap 118*h* between the inner circumferential surface of the fixing film 118*b* in both the end parts in the longitudinal direction of the fixing film 118*b* and the guide surface of the guide member for supporting the fixing film 118*b*.

The small gap 118*h* between the inner circumferential surface of the fixing film 118*b* and the outer circumferential surface of the protrusions 118*g* means a small difference between the inner circumferential length of the fixing film 118*b* and the outer circumferential length of the guide member formed of the film guide 118*e*, the heater stay 118*f*, and the protrusions 118*g*.

Figure 10:
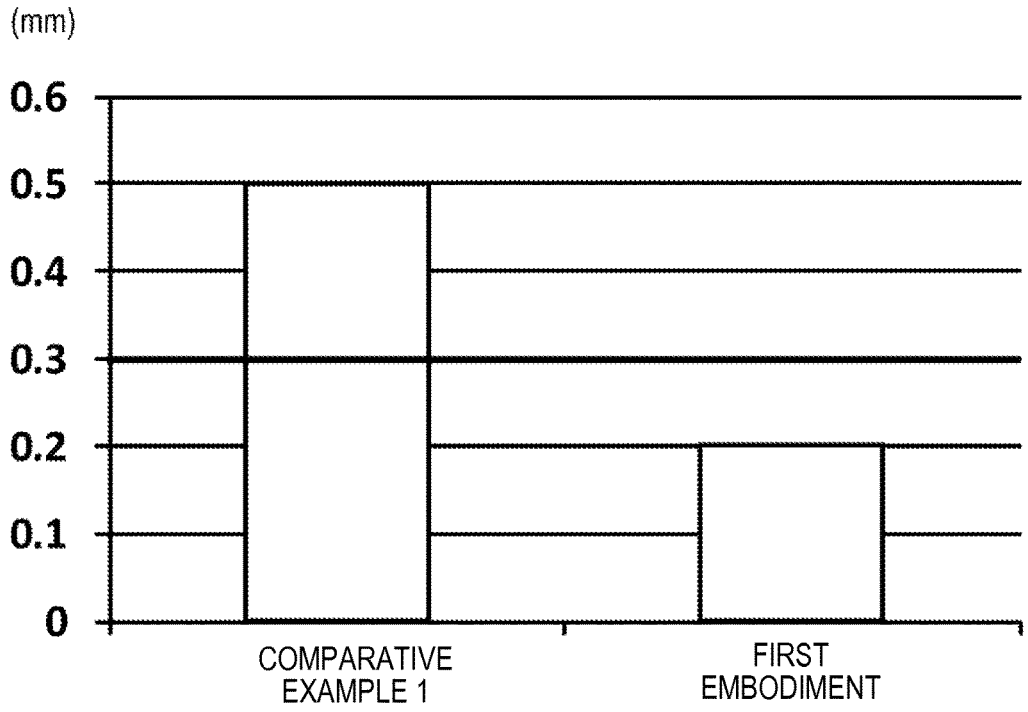
FIG. 10 illustrates a comparison of bias amounts in a longitudinal direction of a fixing film between the first embodiment and the Comparative Example 1.

A method of measuring a bias amount illustrated in FIG. 10 is as follows. A difference (contraction amount) between the initial total length in the longitudinal direction of the fixing film 118*b* of the fixing device 118 and the total length in the longitudinal direction of the fixing film 118*b* after sheet passage was defined as a bias amount (amount of the fixing film 118*b* which is biased to the central part in the longitudinal direction), and a movement amount of the end part of the fixing film 118*b* was measured.

The measurement after sheet passage of the fixing film 118*b* of the fixing device 118 was performed as follows. The fixing device 118 was driven at a circumferential velocity of 100 mm/sec with the temperature of the fixing device 118 being controlled at 200° C. under an N/N environment, and 30 seconds later, one sheet of plain paper of an A3 size having a paper weight of 80 g was passed through the fixing device 118. Then, a contraction amount in the longitudinal direction of the fixing film 118*b* was measured.

The left side of FIG. 10 illustrates the graph obtained by measuring the movement amount of the end part in the longitudinal direction of the fixing film 118*b* as a bias amount through use of Comparative Example 1 illustrated in FIG. 9. The right side of FIG. 10 illustrates the graph obtained by measuring the movement amount of the fixing film 118*b* from the end part to the central part in the longitudinal direction as a bias amount through use of the first embodiment illustrated in FIG. 3.

A design target value of a bias amount, which does not cause bias in the end part in the longitudinal direction of the fixing film 118*b* (film overlapping), was experimentally determined to be 0.3 mm or less. In the configuration of Comparative Example 1 illustrated in FIG. 9, the bias amount was 0.5 mm as illustrated in FIG. 10. On the other hand, in the configuration of the first embodiment illustrated in FIG. 3, the bias amount was 0.2 mm. In the first embodiment, the bias amount was equal to or less than 0.3 mm that was a target value of the bias amount at which film overlapping does not occur.

The heights of the protrusions 118*g* on the end parts sides in the longitudinal direction of the fixing film 118*b* from the upper surface 118*r* of the heater stay 118*f* are set to be larger than that of the protrusion 118*g* in the central part. The bias of the fixing film 118*b* from the end part to the central part in the longitudinal direction is prevented by enhancing the friction force of the protrusion 118*g* with respect to the inner circumferential surface of the fixing film 118*b*.

Figure 5:
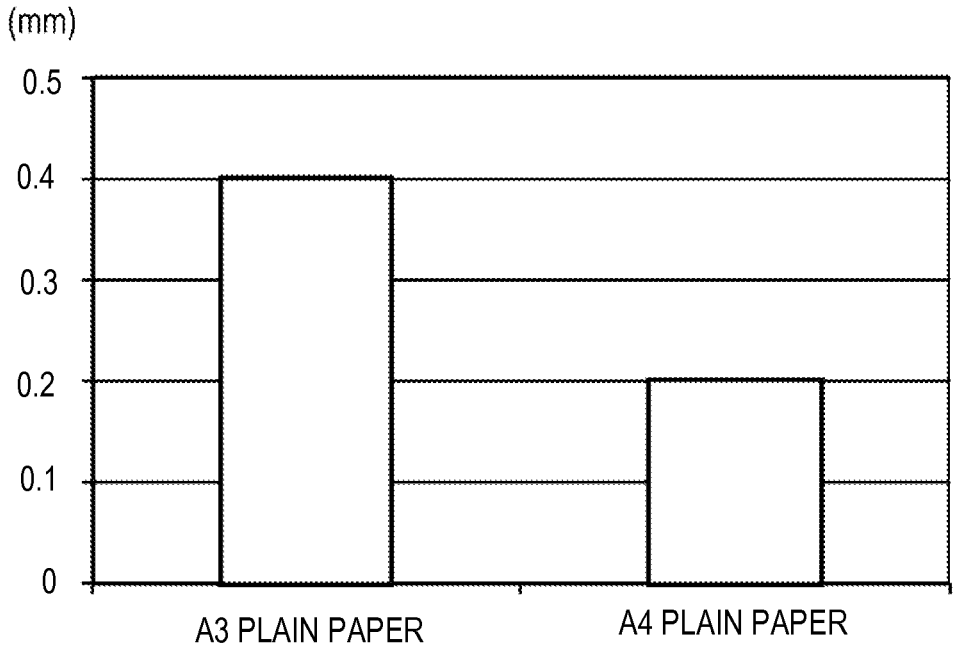
FIG. 5 illustrates contraction amount of paper in the case where a sheet passing through the fixing device according to the first embodiment is paper.

FIG. 5 illustrates a contraction amount of a sheet, which is a difference, between the length of a sheet in the longitudinal direction of the fixing film 118*b* before the sheet passes through the fixing device 118 and the length of the sheet after the sheet passes through the fixing device 118, in the case where the sheet is conveyed to the fixing device 118 whose temperature is controlled at 200° C. under an N/N environment. The left side of FIG. 5 illustrates the graph of the case of plain paper of an A3 size, and the contraction amount of the sheet was 0.4 mm. The right side of FIG. 5 illustrates the graph of the case of plain paper of an A4 size, and the contraction amount of the sheet was 0.2 mm. The A3-size plain paper is grain long, and the A4-size plain paper is grain short. Therefore, a difference occurs in contraction amount between those sheets. The contraction of a sheet occurs when the sheet is heated and moisture thereof is evaporated.

The sheet contraction amount illustrated in FIG. 5 and the bias amount of the fixing film 118*b* after sheet passage illustrated in FIG. 10 are compared to each other. The bias amount of the fixing film 118*b* after sheet passage illustrated in FIG. 10 is 0.5 mm in the configuration of Comparative Example 1 illustrated in FIG. 9 and is larger by 0.1 mm than 0.4 mm of the sheet contraction amount of the A3-size plain paper illustrated in FIG. 5. The difference corresponds to a value of contraction of the fixing film 118*b* itself after the sheet, to which the fixing is performed, takes heat from the fixing film 118*b*. Actually, it was confirmed that, when the fixing film 118*b* was cooled with a blast fan to the surface temperature of the fixing film 118*b* after sheet passage, the fixing film 118*b* itself contracted by about 0.1 mm even without sheet passage.

Film overlapping is caused when the contraction amount of a sheet exceeds the contraction amount of the fixing film 118*b* itself. Specifically, it can be considered as follows. When a sheet is heated and moisture thereof is evaporated, the sheet contracts and the fixing film 118*b* receives a friction force directed to the central part from the sheet. Then, the fixing film 118*b* is biased in the central direction, with result that film overlapping occurs.

In the first embodiment, as illustrated in FIG. 3, in one of contact regions which come into contact with the inner circumferential surface of the fixing film 118*b* serving as a rotatable rotation unit, one of the projections 118*g*1, 118*g*5 in both the end parts in the rotation axis direction of the fixing film 118*b* are present. The height (1.35 mm in the first embodiment) of the projections 118*g*1, 118*g*5 from the upper surface 118*r* of the heater stay 118*f* is set as follows. The height of the projections 118*g*1, 118*g*5 is set to be larger than that of the projection 118*g*3 (1.0 mm in the first embodiment) in the central part. Thus, in the contact regions, the sliding friction resistance between the fixing film 118*b* and the support member in the end parts in the rotation axis direction of the fixing film 118*b* at least becomes largest, which prevents film overlapping of the fixing film 118*b*.

In the first embodiment, the heights of the protrusions 118*g* arranged on the upper surface 118*r* of the heater stay 118*f* are varied between the end parts and the central part in the longitudinal direction. Alternatively, the upper surface 118*r* of the heater stay 118*f* is shaped so as to be higher in the end parts than in the central part, and thereby the end parts are positioned higher than the central part, without using the protrusions 118*g*. Then, the fixing film 118*b* is brought into direct contact with and slid on the upper surface 118*r* of the heater stay 118*f* during rotation of the fixing film 118*b*. In this way, the same effects as those of the above-mentioned first embodiment can be exhibited.

Second Embodiment

In the first embodiment, the height of the protrusions 118*g* in the end parts in the longitudinal direction (right and left direction of FIG. 2) of the heater stay 118*f* from the upper surface 118*r* of the heater stay 118*f* is set to be larger than that of the protrusion 118*g* in the central part from the upper surface 118*r* of the heater stay 118*f*.

In contrast, in a second embodiment of the present invention, the sliding friction resistance between the inner circumferential surface of the fixing film 118*b* and the outer circumferential surface of the protrusions 118*g* is defined by changing the surface roughness of the protrusions without providing a difference between gaps in the end parts and the central part with respect to the projections 118*g* serving as a guide member. The remaining configuration is the same as that of the first embodiment, and hence the description thereof is omitted.

The sliding friction resistance of the protrusions in the end parts in the longitudinal direction (right and left direction of FIG. 2) of the heater stay 118*f* serving as a guide member is set to be larger than the sliding friction resistance of the protrusion in the central part in the longitudinal direction (right and left direction of FIG. 2) of the heater stay 118*f*. Thus, the retention force in the end parts of the fixing film 118*b* becomes large to suppress a bias force toward the central part in the longitudinal direction, which can prevent film overlapping and sheet wrinkles.

In order to achieve the above-mentioned configuration, the surface roughness (rougher than 10 μm in the second embodiment) of the outer circumferential surface of the projections 118*g*1, 118*g*5 in the end parts in the longitudinal direction (right and left direction of FIG. 2) of the heater stay 118*f*, which can come into abutment against the inner circumferential surface of the fixing film 118*b*, is set as follows. The surface roughness of the outer circumferential surface of the protrusions 118*g*1, 118*g*5 in the end parts is set to be larger and rougher than the surface roughness (smoother than 5 μm in the second embodiment) of the outer circumferential surface of the projection 118*g*3 in the central part in the longitudinal direction (right and left direction of FIG. 2) of the heater stay 118*f*, which can come into abutment against the inner circumferential surface of the fixing film 118*b*.

Consequently, the sliding friction resistance in the central part in the longitudinal direction (right and left direction of FIG. 2) of the fixing film 118*b* can be set smaller than the sliding friction resistance in the end parts in the longitudinal direction (right and left direction of FIG. 2) of the fixing film 118*b*.

Further, in the contact regions in which the inner circumferential surface of the rotating fixing film 118*b* and the outer circumferential surface of the support member come into contact with each other, the sliding friction resistance in the end parts in the rotation axis direction of the fixing film 118*b* at least becomes largest. This increases the retention force that retains the fixing film 118*b* in the end parts in the rotation axis direction to suppress a bias force toward the central part in the longitudinal direction, which can prevent film overlapping and sheet wrinkles.

In the second embodiment, the difference between the sliding friction resistance in the central part and the sliding friction resistance in the end parts is defined by the surface roughness of the protrusions. However, the present invention is not limited thereto. At least one surface on the end part side of the inner circumferential surface of the rotation unit and the outer circumferential surface of the support unit which come into contact with each other may be roughened. For example, the surface roughness in the end part of the inner circumferential surface of the fixing film 118*b* is set to be larger than that in the central part. Although the difference in sliding friction resistance is defined by the surface roughness of the contact part, the difference between the sliding friction resistance in the central part and the sliding friction resistance in the end parts may be caused by coating the protrusion in the central part with a lubricant such as grease.

Film overlapping and sheet wrinkles may be prevented by combining the first embodiment described above with the second embodiment. Although the rotation member serving as a rotation unit is described through use of the fixing film, the rotation member is not limited to a film, and a belt-shaped rotation member may be applied.

In the heating device of the present invention, the gap in the longitudinal direction (rotation axis direction) between the inner circumferential surface of the fixing film and the guide surface of the guide member for guiding the fixing film is set to be small. Further, the gap in the end parts in the longitudinal direction (rotation axis direction) between the fixing film and the guide member is set to be smaller than the gap in the central part in the longitudinal direction (rotation axis direction) between the fixing film and the guide member. This can prevent warping of the rotating fixing film and suppress a bias force of the fixing film toward the center in the longitudinal direction (center in the rotation axis direction) caused by the sliding friction resistance between the guide member and the fixing film in the end parts in the longitudinal direction (end parts in the rotation axis direction) of the rotating fixing film. Consequently, wrinkles can be prevented from occurring on a sheet, and film overlapping can also be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-284326, filed Dec. 27, 2012, and No. 2013-235527, filed Nov. 14, 2013 which are hereby incorporated by reference herein in their entirety.

What is claimed is:

1. A fixing device, comprising:

a rotation unit fixing a toner image onto a sheet and having a band shape, a central part of the rotation unit in a rotation axis direction having a diameter smaller than a diameter of an end part of the rotation unit in the rotation axis direction; and a support unit rotatably supporting the rotation unit by a first protrusion and a second protrusion, wherein the first protrusion is configured to abut against an inner circumferential surface of the rotation unit at the end part in the rotation axis direction, and wherein the second protrusion is configured to abut against the inner circumferential surface at the central part in the rotation axis direction and has a height lower than the height of the first protrusion, wherein, when the rotation unit rotates, gaps between the inner circumferential surface of the rotation unit and the first and second protrusions are smaller than that when rotation of the rotation unit stops, and wherein, when the rotation of the rotation unit stops, the gap between the inner circumferential surface of the rotation unit and the first protrusion is smaller than the gap between the inner circumferential surface of the rotation unit and the second protrusion.

2. The fixing device according to claim 1, wherein the support unit has multiple protrusions configured to abut against the inner circumferential surface of the rotation unit, and wherein the multiple protrusions include the first and second protrusions, and wherein a line connecting outer circumferential surfaces of the multiple protrusions has a reversed crown shape.

3. The fixing device according to claim 1, further comprising:

a rotatable pressure member against which the rotation unit abuts and which fixes the toner image onto the sheet, wherein a region of the support unit, which opposes the pressure member through intermediation of the rotation unit, has a crown shape in which an outer diameter of a central part of the support unit in the rotation axis direction becomes larger than an outer diameter of an end part of the support unit in the rotation axis direction, and wherein the dimension difference between the outer diameter of the end part of the support unit and the outer diameter of the central part of the support unit is smaller than the dimension difference between the height of the first protrusion and the height of the second protrusion.

4. The fixing device according to claim 1, wherein the dimension difference between the height of the first protrusion and the height of the second protrusion is larger than the sum of the dimension difference between an outer diameter of an end part of the support unit and an outer diameter of a central part of the support unit and the diameter difference between the diameter of the end part of the rotation unit and the diameter of the central part of the rotation unit.

5. The fixing device according to claim 1, wherein the rotation unit has a first end part and a second end part in the rotation axis direction, and wherein the diameter of the central part of the rotation unit increases symmetrically in the rotation axis direction from the central part toward the first and second end parts.

6. An image forming apparatus for forming the toner image on the sheet, comprising an image forming part having the fixing device according to claim 1.

7. A fixing device, comprising:

a rotation unit fixing a toner image onto a sheet and having a band shape, a central part of the rotation unit in a rotation axis direction having a diameter smaller than a diameter of an end part of the rotation unit in the rotation axis direction;

a support unit rotatably supporting the rotation unit by a first protrusion and a second protrusion, wherein the first protrusion is configured to abut against an inner circumferential surface of the rotation unit at the end part in the rotation axis direction and the second protrusion is configured to abut against the inner circumferential surface of the rotation unit at the central part in the rotation axis direction; and a rotatable pressure member against which the rotation unit abuts and which fixes the toner image onto the sheet, wherein the second protrusion has a height lower than the height of the first protrusion, and wherein the first protrusion and the second protrusion are arranged on a side of the support unit opposite to a nip surface, in which the rotation unit and the rotatable pressure member fix the toner image, in a direction perpendicular to the nip surface at a central part of the nip surface.

8. The fixing device according to claim 7, wherein, when the rotation unit rotates, gaps between the inner circumferential surface of the rotation unit and the first and second protrusions are smaller than that when rotation of the rotation unit stops, and wherein, when the rotation of the rotation unit stops, the gap between the inner circumferential surface of the rotation unit and the first protrusion is smaller than the gap between the inner circumferential surface of the rotation unit and the second protrusion.

9. The fixing device according to claim 7, wherein the support unit has multiple protrusions configured to abut against the inner circumferential surface of the rotation unit, and wherein the multiple protrusions include the first and second protrusions, and wherein a line connecting outer circumferential surfaces of the multiple protrusions has a reversed crown shape.

10. The fixing device according to claim 7, wherein a region of the support unit, which opposes the pressure member through intermediation of the rotation unit, has a crown shape in which an outer diameter of a central part of the support unit in the rotation axis direction becomes larger than an outer diameter of an end part of the support unit in the rotation axis direction, and wherein the dimension difference between the outer diameter of the end part of the support unit and the outer diameter of the central part of the support unit is smaller than the dimension difference between the height of the first protrusion and the height of the second protrusion.

11. The fixing device according to claim 7, wherein the dimension difference between the height of the first protrusion and the height of the second protrusion is larger than the sum of the dimension difference between an outer diameter of an end part of the support unit and an outer diameter of a central part of the support unit and the diameter difference between the diameter of the end part of the rotation unit and the diameter of the central part of the rotation unit.

12. An image forming apparatus for forming the toner image on the sheet, comprising an image forming part having the fixing device according to claim 7.

* * * * *